United States Patent [19]

Ehret et al.

[11] 4,402,350

[45] Sep. 6, 1983

[54] SYSTEM FOR THE CONTROL OF A MARINE LOADING ARM

[75] Inventors: Thomas M. Ehret, Malay Le Grande; Gérard E. Ovieve, Sens, both of France

[73] Assignee: FMC Corporation, Chicago, Ill.

[21] Appl. No.: 334,004

[22] Filed: Dec. 23, 1981

Related U.S. Application Data

[63] Continuation of Ser. No. 205,855, Nov. 10, 1980, abandoned.

[30] Foreign Application Priority Data

Nov. 12, 1980 [GB] United Kingdom ..... 7939091

[51] Int. Cl.[3] ..... B65B 57/00; B67C 5/32

[52] U.S. Cl. ..... 141/94; 141/279; 141/387; 33/1 MP; 137/615; 340/686; 364/463

[58] Field of Search ..... 137/236 R, 236 S, 615; 33/1 CC, 1 MP; 141/94–96, 279, 387–389, 392, 284; 340/685, 686, 679, 501; 414/137–140; 212/149, 153; 364/463

[56] References Cited

U.S. PATENT DOCUMENTS

| | | | |
|---|---|---|---|
| 1,931,107 | 10/1933 | Dowell et al. . | |
| 2,588,842 | 3/1952 | Hutt . | |
| 2,855,886 | 10/1958 | Svoboda . | |
| 2,898,954 | 8/1959 | Freeman . | |
| 3,050,092 | 8/1962 | Palcanis et al. . | |
| 3,073,280 | 1/1963 | Thiel . | |
| 3,505,514 | 4/1970 | Fathauer . | |
| 3,566,386 | 2/1971 | Hamilton . | |
| 3,586,841 | 6/1971 | Griffin . | |
| 3,618,064 | 11/1971 | Hamilton . | |
| 3,636,325 | 1/1972 | Chytil . | |
| 3,638,211 | 1/1972 | Sanchez | 364/463 |
| 3,819,922 | 6/1974 | Horn et al. . | |
| 3,833,130 | 9/1974 | Gerdes et al. . | |
| 3,833,932 | 9/1974 | Hamilton . | |
| 3,854,128 | 12/1974 | Yamagishi . | |
| 3,870,160 | 3/1975 | Hutchings | 364/463 |
| 3,922,789 | 12/1975 | Sarrell . | |
| 3,932,855 | 1/1976 | Hamilton . | |
| 3,934,126 | 1/1976 | Zalesov et al. . | |
| 3,944,798 | 3/1976 | Eaton . | |
| 3,986,007 | 10/1976 | Ruoff, Jr. . | |
| 4,006,347 | 2/1977 | Hohmann . | |
| 4,084,247 | 4/1978 | Ball . | |
| 4,156,835 | 5/1979 | Whitney et al. . | |
| 4,185,280 | 1/1980 | Wilhelm . | |
| 4,187,454 | 2/1980 | Ito et al. . | |
| 4,190,080 | 2/1980 | Devahat | 141/387 |
| 4,205,308 | 5/1980 | Haley et al. . | |

OTHER PUBLICATIONS

Automatische Laadinstallaties voor Mineraalolieprodukten met AEG Procescomputers.

Computer Monitored Liquid Fuel Loading—Computers in Practice, D. P. Dowling, Mobil Services Company, Ltd., London, England, and A.L. Quak, Foxboro Nederland N.V., Soest, The Netherlands.

*Primary Examiner*—Houston S. Bell, Jr.

*Attorney, Agent, or Firm*—W. William Ritt, Jr.; Richard B. Megley

[57] ABSTRACT

A system for sensing the position in space of the outer end of an articulated loading arm connected to a marine tanker or other transport vessel, for predicting if the arm will move outside a safe operating envelope, for discontinuing the flow of fluid before the arm reaches an unsafe area, and for disconnecting the arm from the vessel when the arm reaches an unsafe area. The sensing system includes means for determining various angles representative of the orientation of the limbs of the loading arm, and a computer for using these angles to compute the spatial position of the arm's outer end. The computer uses the spatial position and movement of the loading arm to predict future positions of the outboard end of the arm, and to determine if the loading operation should be terminated and the arm disconnected from the vessel. When the computer predicts that the loading arm may move outside a first operating envelope an alarm is sounded. When the computer predicts that the arm may move outside a second operating envelope the flow of fluids through the arm is automatically discontinued, and if the computer predicts that the loading arm may move outside a third operating envelope the arm is automatically disconnected from the vessel.

8 Claims, 17 Drawing Figures

FIG_5
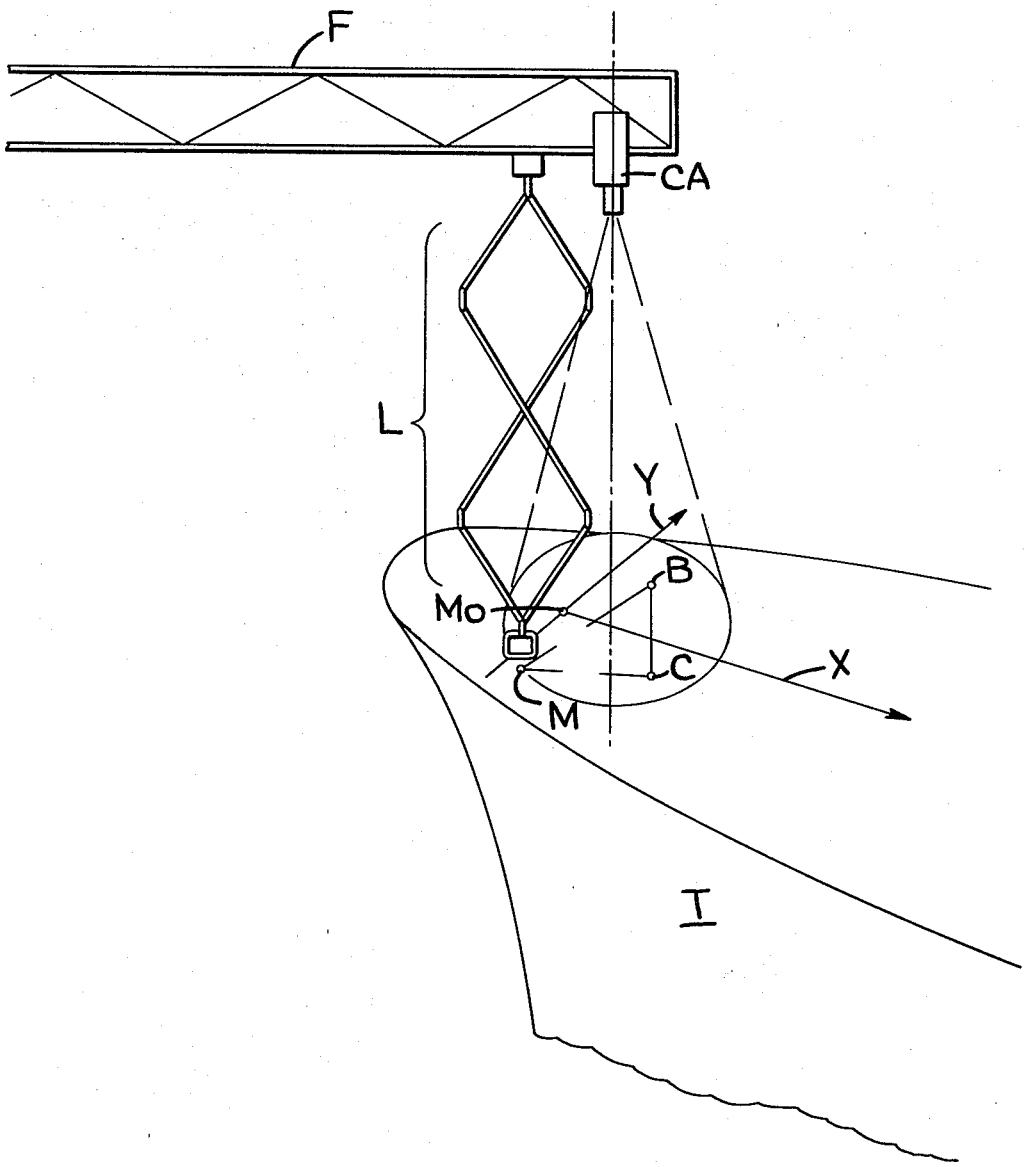
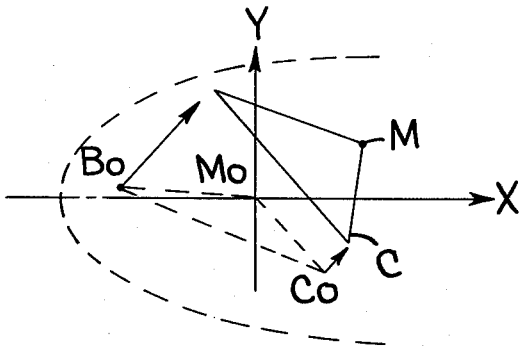
FIG_6

EMERGENCY DISCONNECTION PROCEDURE

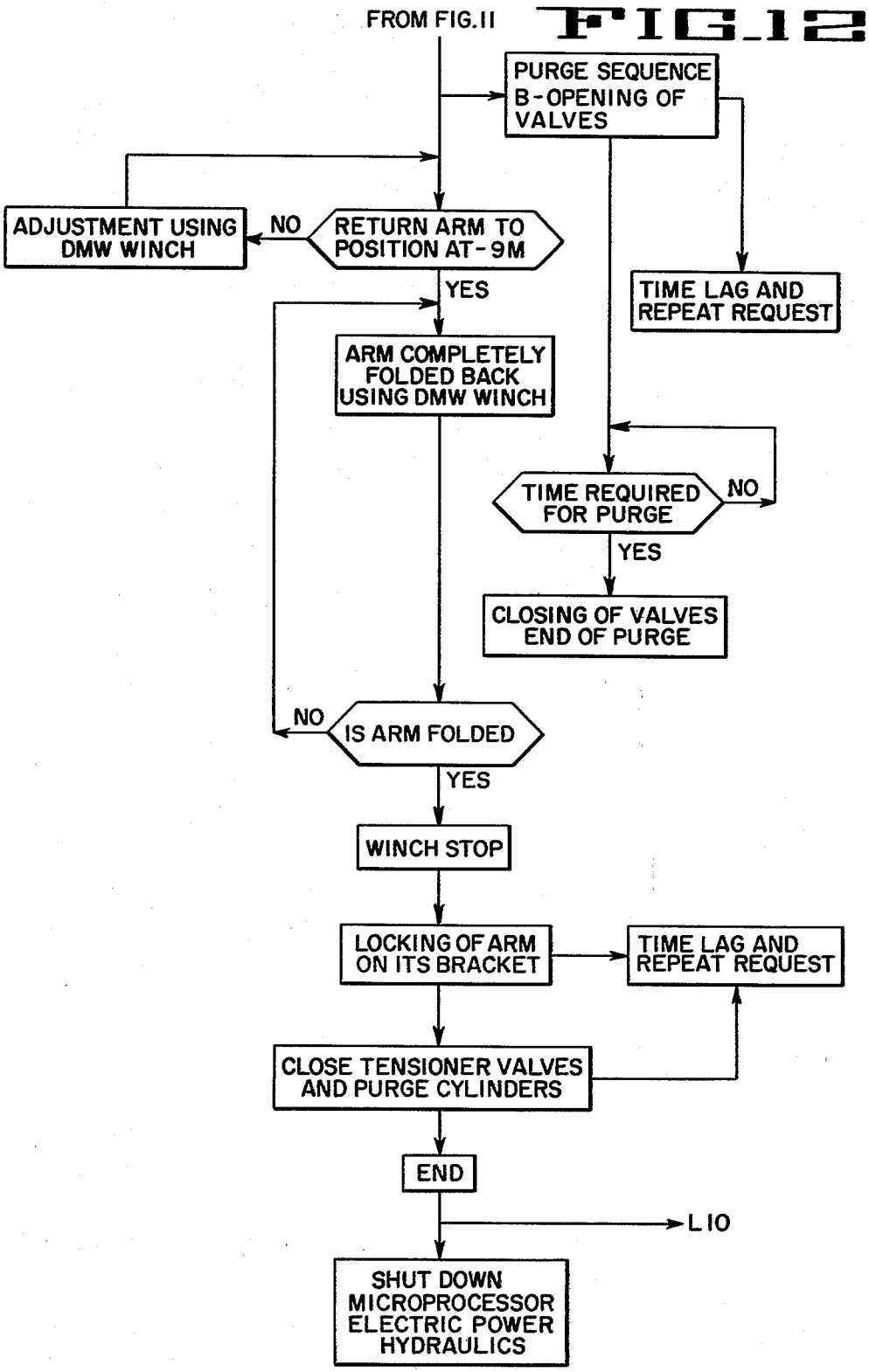
FIG_12
FROM FIG.11
PURGE SEQUENCE B-OPENING OF VALVES
ADJUSTMENT USING DMW WINCH
NO
RETURN ARM TO POSITION AT-9M
YES
TIME LAG AND REPEAT REQUEST
ARM COMPLETELY FOLDED BACK USING DMW WINCH
TIME REQUIRED FOR PURGE
NO
YES
CLOSING OF VALVES END OF PURGE
NO
IS ARM FOLDED
YES
WINCH STOP
LOCKING OF ARM ON ITS BRACKET
TIME LAG AND REPEAT REQUEST
CLOSE TENSIONER VALVES AND PURGE CYLINDERS
END
L10
SHUT DOWN MICROPROCESSOR ELECTRIC POWER HYDRAULICS

ANALYSIS OF X MOTION (SURGE)

ANALYSIS OF Y MOTION (SWAY)

ANALYSIS OF Z MOTION (HEAVE)

TIME LAG AND REPEAT REQUEST

BREAK DOWN PROCEDURE

SYSTEM FOR THE CONTROL OF A MARINE LOADING ARM

This application is a continuation, of application Ser. No. 205,855, filed Nov. 10, 1980 now abandoned.

BACKGROUND OF THE INVENTION

1. Field of the Invention

This invention relates to articulated fluid transferring apparatus, and more particularly to apparatus for determining the spatial position of the outer end of marine loading arms and for disconnecting such arms from a floating vessel when a computer predicts that the outer ends of such arms may move into a danger area.

2. Description of the Prior Art

Fluid loading arms constructed of articulated pipe are extensively used in the petroleum industry for transferring oil or other fluids between a buoy or other loading terminal and a marine tanker. Such arms generally comprise an inboard limb boom supported on the buoy or loading terminal by a pipe swivel joint assembly to facilitate pivotal movement about horizontal and vertical axes, and an outboard limb pivotally connected by a pipe swivel joint to the inboard limb or boom for movement relative thereto about a horizontal axis. The outer end of the outboard limb is adapted to be connected to a pipe manifold on a tanker located within reach of the arm, such as by a remotely-controllable coupler device.

When an installation of this type is being designed, minimum requirements are set for the reach of the arm. These requirements are expressed in terms of the maximum horizontal displacement of the tanker parallel to and away from the buoy relative to a datum position, the maximum displacement away from the buoy due to variations in distance between the tanker manifold and the tanker rail, and the maximum vertical displacement due to variations in the water level and the height of the tanker manifold relative to the water level.

These displacements define a three-dimensional space that is rectangular in section when viewed in plan or in elevation, either parallel to or perpendicular to the jetty, and the space is known as the arm's "operating envelope". The arm must be able to accommodate all of these displacements so that a safe and secure connection to the tanker's manifold can be established and maintained within the limits of this envelope.

Most articulated arms are counterbalanced so that when empty they are substantially self-supporting. However, the weight of the oil or other fluid in the arm during use is not counterbalanced and thus must be supported in part by the tanker manifold to which the arm is connected. Clearly, the stress on the manifold increases with the extension of the arm. In addition, the manifold always faces toward the tanker rail, and the stress to which the manifold can be subjected in a direction perpendicular to the rail, and hence to the jetty, is greater than the stress to which it can be subjected parallel to the rail. The stress parallel to the rail increases with an increase in the slew angle, that is the angle between the vertical plane in which the arm resides and the vertical plane through the riser and normal to the edge of the jetty. Thus, to prevent the stress on the manifold from exceeding safe limits, the extension of the arm and the slew angle must be limited.

To achieve this limitation, alarm systems have been provided for actuation in the event of the angle between the inboard and outboard limbs exceeding a predetermined limit, or in the event the slew angle exceeds a predetermined limit. These prior art systems are not entirely satisfactory as the outboard end of the arm may continue to move beyond the safe limit and the manifold may be damaged before fluid flow through the arm can be stopped and the arm disconnected from the tanker manifold. A more satisfactory system would be to use the movement of the outer end of the loading arm to predict when the arm may move outside the safe area, and to start a shutdown procedure before the arm reaches the danger area.

SUMMARY OF THE INVENTION

The present invention comprises a system for sensing the position in space of the outer end of an articulated fluid loading arm, and for using the movement of the arm to determine if its outer end is likely to move into an unsafe area. Sensors are used to measure the horizontal and vertical orientation of portions of the arm, and calculating means uses these measurements to determine the spatial position of the outer end of the arm. The boundaries of a safe working area are stored in the system, and the spatial position of the arm is compared with the boundaries of the safe working area. The position of the outer end of the arm in relation to the safe boundaries, and the movement of said outer end, are used to predict whether the arm may move out of the safe working area. When movement of the arm out of the safe working area is predicted, the system terminates the flow of fluid in the arm, and if continued movement of the arm move away from the safe working area is predicted the system then disconnects the arm from the tanker. An alarm can be generated if the outer end of the arm reaches a first set of safe boundaries. The fluid flow can be stopped when the system predicts that the arm may move to a second set of boundaries, and the arm can be disconnected from the tanker when the system predicts that the arm may move to a third set of boundaries.

BRIEF DESCRIPTION OF THE DRAWINGS

FIG. 5 is a fragmentary view of the bow of a tanker and a loading arm connected thereto, showing a camera on the arm boom for observing the movement of a target on the tanker deck.

FIG. 6 is a plan of the viewed area of FIG. 5.

FIGS. 8–17 are flow charts showing the operation of the loading arm.

DESCRIPTION OF THE PREFERRED EMBODIMENT

Figure 1:
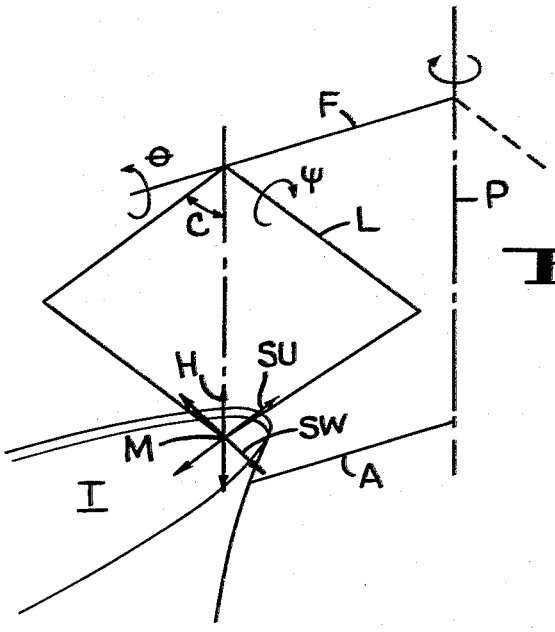
FIG. 1 is a schematic illustration of an articulated loading arm connected to a marine tanker at an offshore loading terminal.
Figure 2:
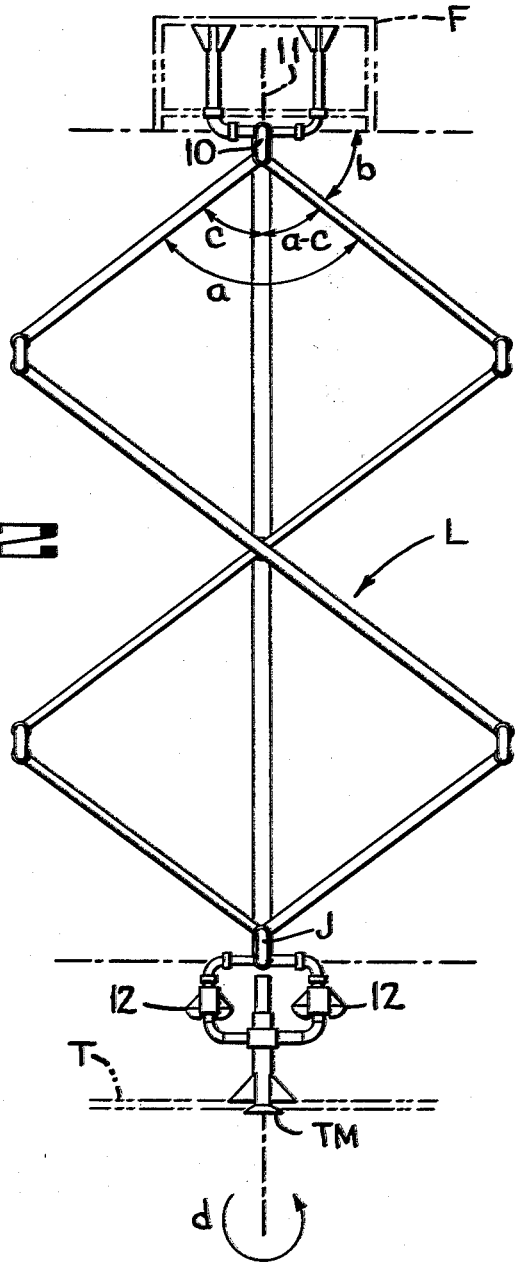
FIG. 2 is a front elevation of the outboard limb of an articulated loading arm connected between the inboard limb or boom and a tanker.

Referring to FIGS. 1–6 of the drawings, a loading arm equipped with a system according to the present invention may comprise an inboard limb or boom F pivotally connected to an offshore terminal or platform P and extending generally horizontally toward a tanker T, with the boom F pivotal about a vertical axis V and a horizontal axis H. The tanker T is secured to the offshore platform P by means of a hawser or mooring line A (FIG. 1). An articulated outboard fluid transfer limb L is suspended from the outer portion of the boom F (FIG. 2) for rotation about a vertical axis 10 and a horizontal axis 11, and with the lower end of the limb L connected to a tanker manifold TM (FIG. 2) located at a point M (FIGS. 1 and 5). The articulated loading arm has at least one device (not shown) for stopping the flow of fluid, and includes emergency disconnect devices 12 to provide quick disconnection from the tanker. The arm limb L shown in FIG. 2 is of the accordion or double-diamond design, but other arm designs also can be used with the present invention. The point M may move relative to the platform in any of the directions shown by the arrows H,SU and SW (FIG. 1), all according to the motions of the tanker resulting from waves, currents, and tides in the sea.

The point M is located in a pendular plane in which the arm limb L resides, and any angular or linear shift of that plane corresponds to coordinates which are variable in space of the point M. The axis OX (FIG. 4) corresponds to the longitudinal axis of the vessel. The variable coordinates of the point M can be measured at any appropriate points on the arm limb L, on the boom F, or on the tanker itself.

The state of the sea influences the angular and linear motions of the tanker, causing it to have a slow or fast motion, to vary in the course of time, and to depend on the points on the Earth where the vessel is situated. Thus, tide and currents provoke rather slow linear motions, whereas waves provoke rather fast angular and linear motions of the tanker. The amplitude and duration of the oscillations of the tanker actually depend upon several parameters and their mutual relationships (dimensions, directions and speed of propagation of the surge; dimensions, inertia and righting torque of the tanker, and the like). The tanker itself is therefore a significant factor as determined by its dimensions, type of construction, resistance to the sea as well as to the wind, and depending upon whether it is loaded or empty. The force and direction of the winds also determine the direction in which the tanker drifts or tends to drift.

In accordance with one embodiment of the present invention, a system of sensors are employed to collect and record, as completely as possible, various data and events of variable frequency, whether of regular or irregular occurrence, accidental or scarce, occurring in various sites and having variable significance in the scale of the potential risks of damage and/or accidents, at various reference points on the tanker and the loading arm. This data is inventoried, statistically analyzed, stored in a computer memory, and periodically updated for use in predicting whether fluid flow should be stopped, and whether the arm should be disconnected from the tanker. The parameters which are used to define movement of the tanker depend on the reference point being considered, the state of the sea, and the hydrodynamic characteristics of the tanker. During the fluid loading/unloading operation the sensors measure the variable motions of the tanker manifold point M, and this information is continuously supplied to the computer. The computer continuously analyzes this information and compares it with the data in its memory. As a result of this continuous comparison, the computer supplies signals which can be used to halt the flow of fluid in the loading arm and, if necessary, to disconnect the arm from the tanker. The signals for halting fluid flow and disconnecting the arm must be supplied sufficiently in advance to take into account the inertia of the fluid flow control valve or other shutoff device, and the time to effect emergency disconnection. When the computer predicts that the outer end of the loading arm may reach a first threshold boundary an alarm is sounded; when the computer predicts that the outer end of the arm may reach a second boundary, the fluid flow is terminated; and when the computer predicts that the outer end of the arm may reach a third threshold the arm is disconnected from the tanker.

In accordance with the present invention, the probability of the arm exceeding a working envelope enclosing all possible locations of the point M is calculated; for example, it can be predicted that the probability for point M to cross the boundary of the working envelope in ten years is lower than 1/100. However, the working envelope does not take into account slow movements of the tanker. The loading arm is designed so that it can be safely operated at any location within this envelope. Since the volume of the working envelope increases very fast as movement of the tanker manifold point M increases, in practically all cases it is necessary to set limits to the movement of point M. These limits are also required because of the limitations of the mooring facility, and of the prevailing safety requirements. The point M can move in a three-dimensional area bounded by the surface S (FIG. 3) of a working envelope defined by H,W and SU (FIGS. 1 and 3) with a vertical axis through a point Mo (FIG. 3), this point being the nominal tanker manifold connection point of the arm. The computer insures that point M never crosses outside the working envelope S. Since for a given set of coordinates the point M is fixed, the coordinates of M may be determined in a system centered at Mo.

Figure 3:
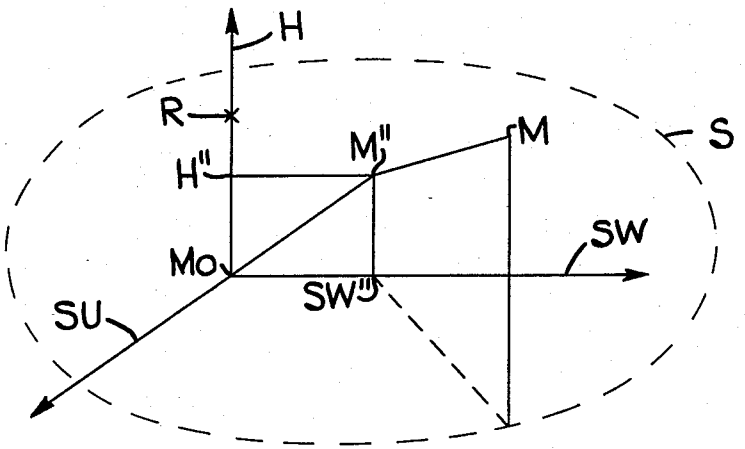
FIG. 3 illustrates the working area of an articulated loading arm connected to a tanker.
Figure 7:
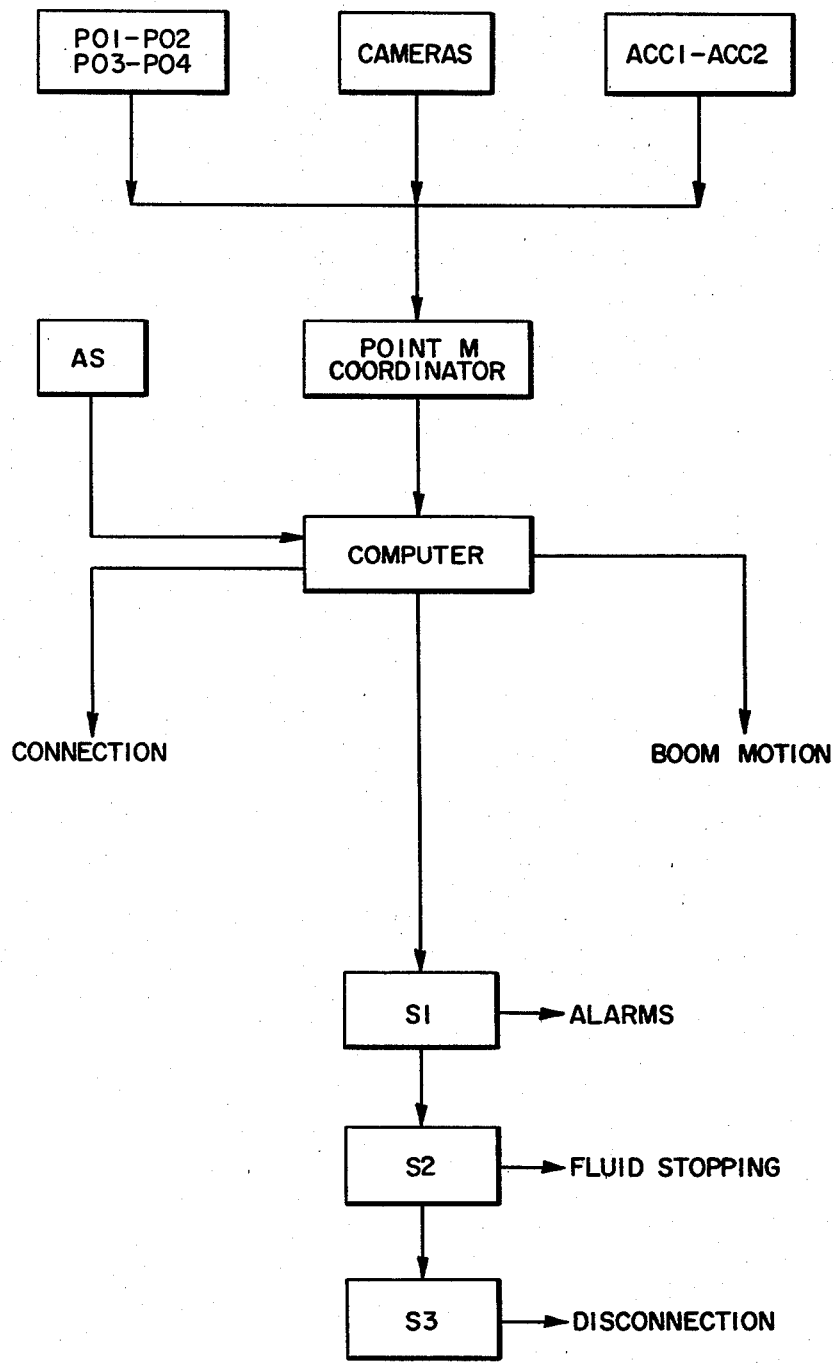
FIG. 7 is a block diagram of a system for controlling the operation of the loading arm.

When the arm is disconnected from the tanker the point M moves to a rest position R (FIG. 3). There are two possibilities of action which can be taken by the computer (1) resetting Mo by bringing it to M, in which case the limiting surface and the resting position R follow point Mo; (2) disconnecting the system, in which case M goes back into R. With respect to action (2), during its movement the point M might cross over the limiting surface. Other tasks of the computer are: (1) checking that the above-mentioned limits are not reached; (2) correcting for slow movements of the vessel; (3) controlling the required operational steps at the beginning and end of the loading/unloading operation; (4) informing operators about the situation and the operations in progress; and (5) taking measures as provided for in case of emergencies.

Linear and angular motions of the loading arm are calculated from measurements made either on the arm limb L by angle sensors or accelerometers and transmitted by cables, or measurements outside the arm by optical or laser camera means or a camera assembly, or measurements on the vessel by means of a "Datawell" buoy and radio wave transmission. Movements of the point M are measured before, during, and after connection of the arm limb L to the tanker T.

During the loading/unloading operation the boom F remains substantially in a horizontal attitude and yet is free to move in two manners: (1) rotation about a vertical axis at the platform, so as to permit the arm limb L to follow the horizontal drift of the tanker, and (2)

rotation about a horizontal axis at the platform to enable the arm to move up and down and follow the vertical drift of the vessel, mainly caused by the tide. A pair of accelerometers can be provided to measure the vertical motion in the Z direction (FIG. 4) and the horizontal motion in the Y direction. Signals from the accelerometers are integrated twice to obtain the vertical and the horizontal motions of the loading arm.

When the arm is connected to the vessel T, the geometry of the arm limb L is determined by several angles which are measured by means of potentiometers. Measurements of the angles a, b and c (FIG. 2) determine the coordinates X, Y, Z (FIG. 4) of the point J (FIG. 2) at the attachment of the arm to its connector assembly. The attitude of the tanker T can be determined by measuring the angle of gyration yaw d (FIG. 2) at the base of the arm limb L. The measuring instruments may comprise potentiometers mounted at various points on the loading arm, and a potentiometer mounted at point M on the tanker bow.

Figure 4:
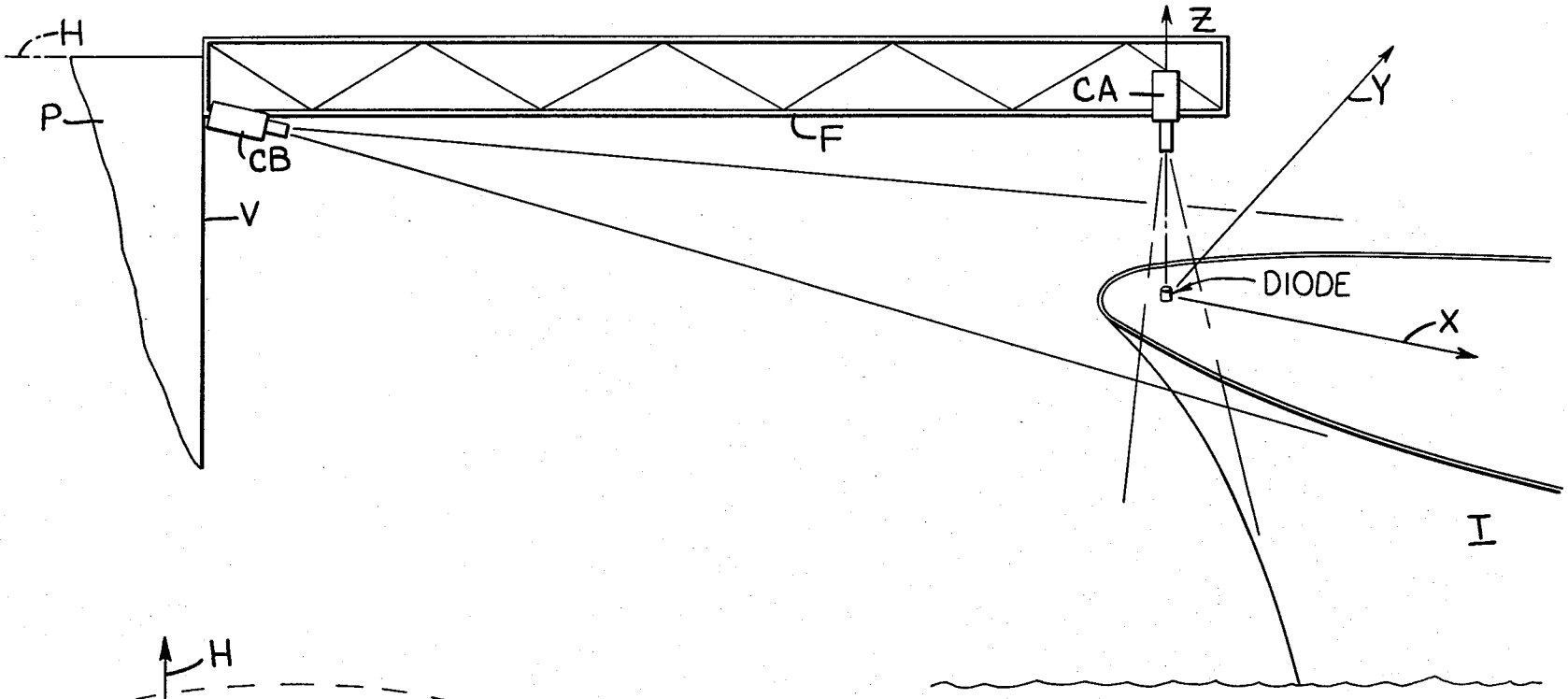
FIG. 4 is a perspective view illustrating a pair of cameras mounted on a boom to observe the bow of a tanker.

The movement of point M on the tanker bow can be determined according to one form of the embodiment by using two cameras CB and CA, with one camera mounted at the outboard end of the boom and the other at the base of the boom as shown in FIG. 4. A transmitting diode is mounted at the vessel bow close to the point M, and both cameras are aimed at this diode to observe the tridimensional motion of the tanker bow relative to a reference point of the boom F. These cameras are installed so that they both always look at point M regardless of the position of the arm limb L. Camera CB records the amount of deviation from the Y and Z axis, and camera CA records the amount of deviation from the Y and X axis. The position of the transmitting diode can be determined by the number of degrees the camera is pointing away from the X, Y and Z coordinates on a reference system. It should be noted that in this form of the invention there is no requirement for any connection, either by electrical means or radio waves, to the receiving cameras.

A simplified form of the foregoing embodiment uses a single camera CA (FIG. 5) at the outboard end of the boom pointed downward to a pair of points B and C that are located on the tanker bow at a stationary position relative to point M. These points are provided with transmitting diodes spaced a known distance apart. By measuring the positions of these two points and the angular distance between them as seen from the camera at any instant of time, it is possible to supply the absolute coordinates X and Y of both of these points on the tanker bow, and the coordinates X and Y of point M. The vertical distance Z cannot be measured by the camera, and supplementary equipment, such as an infrared range finder or other equivalent device, is required to measure this distance.

Figure 8:
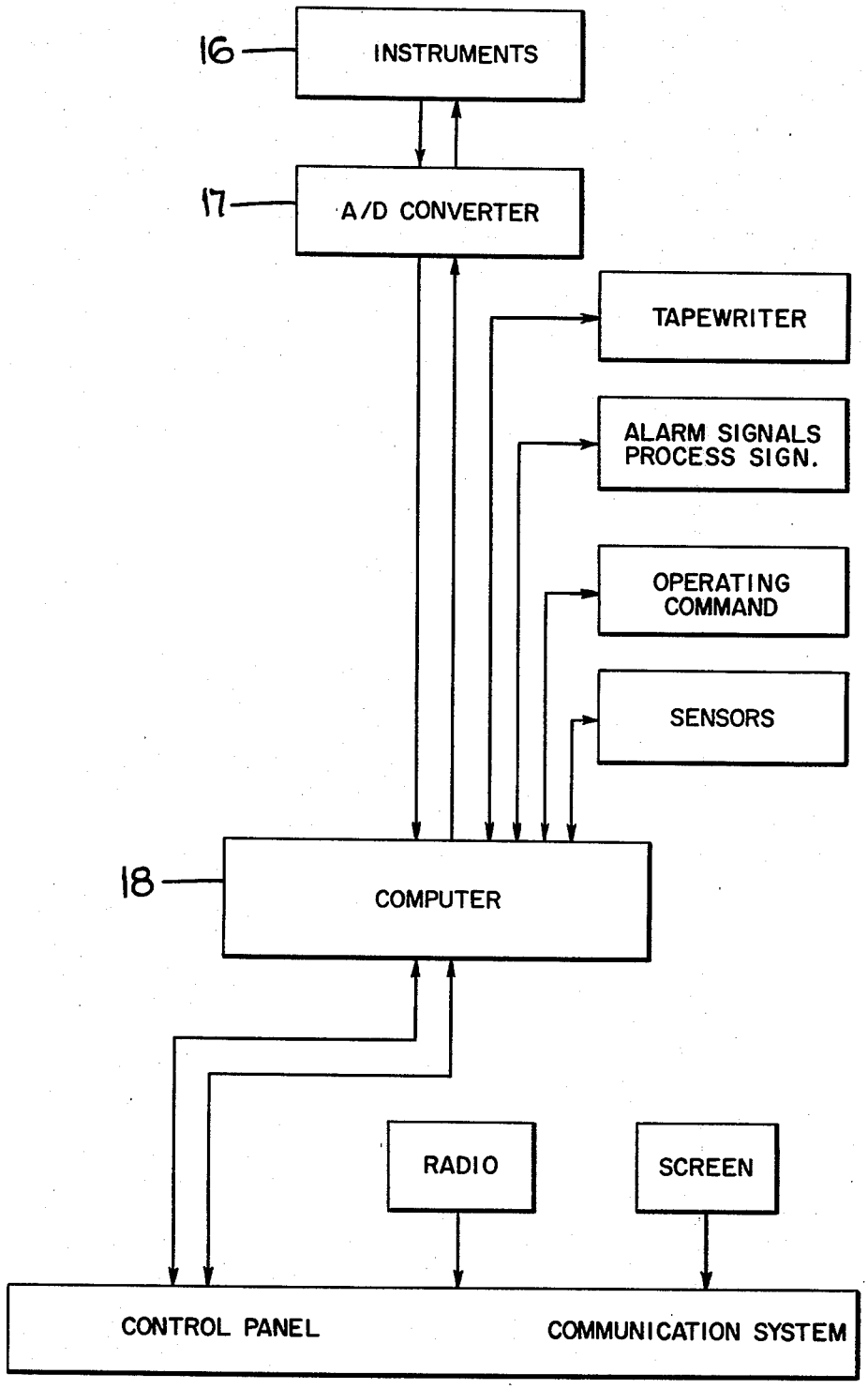
Figure 9:
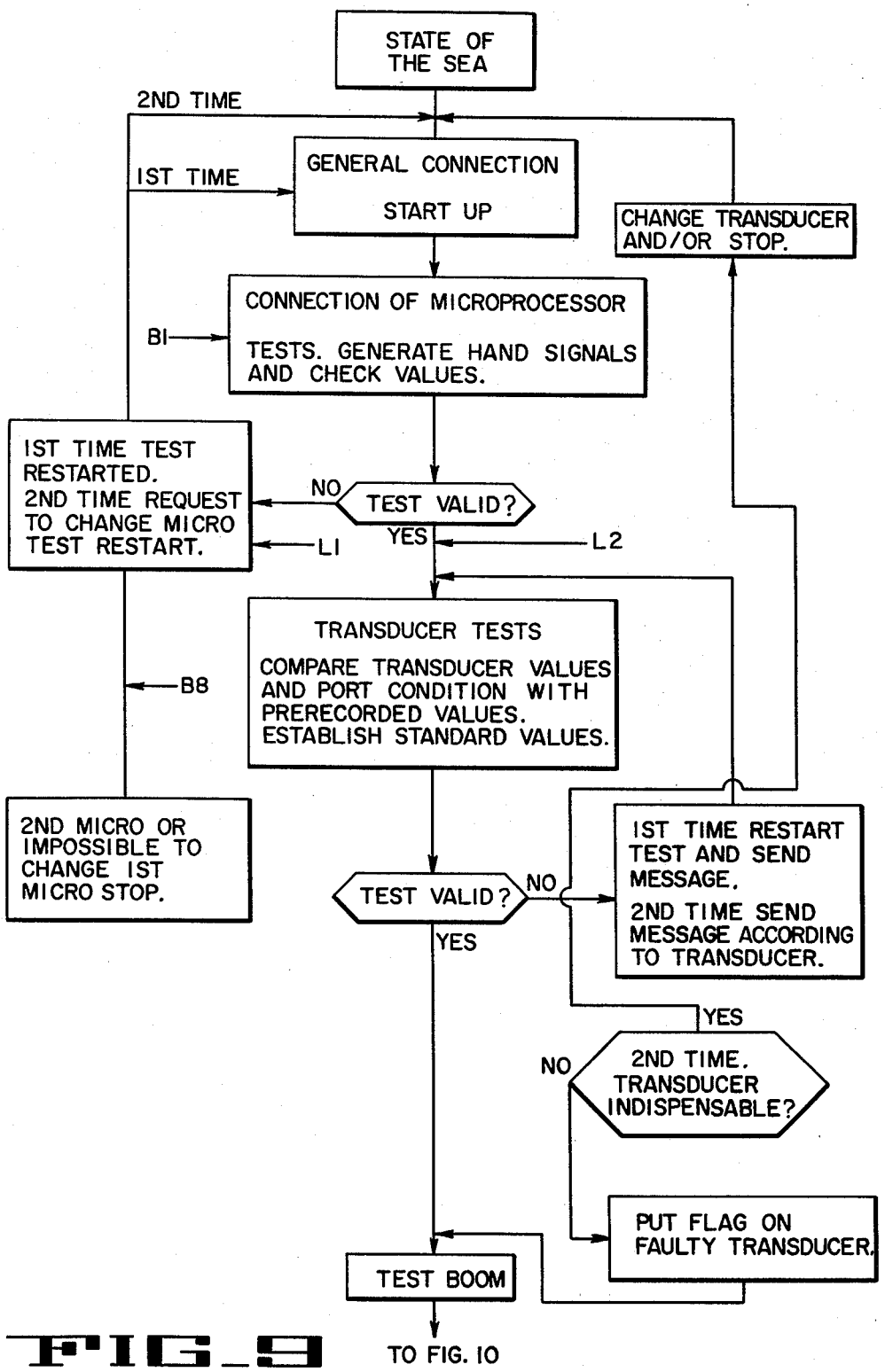
Figure 10:
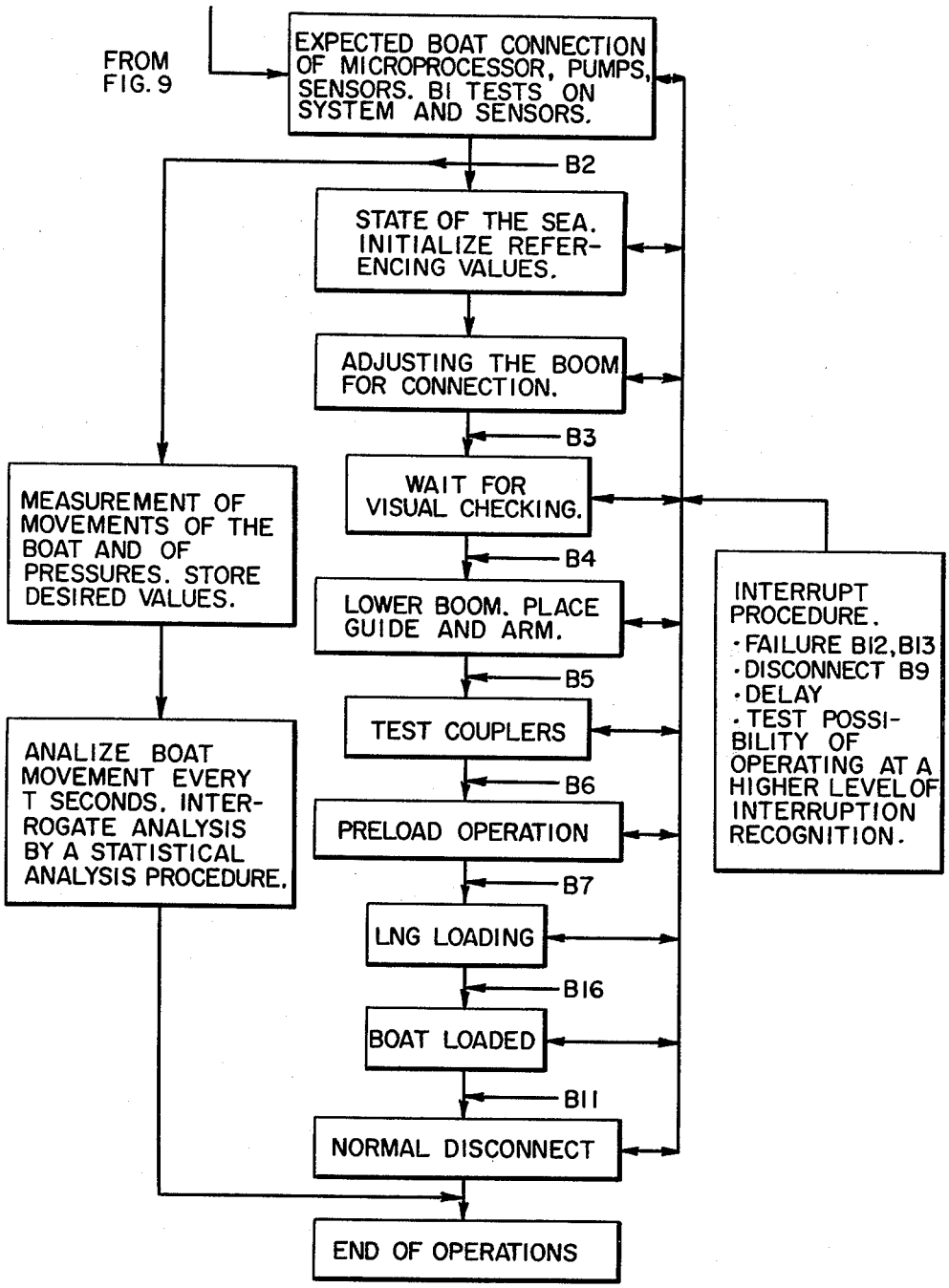
Figure 11:
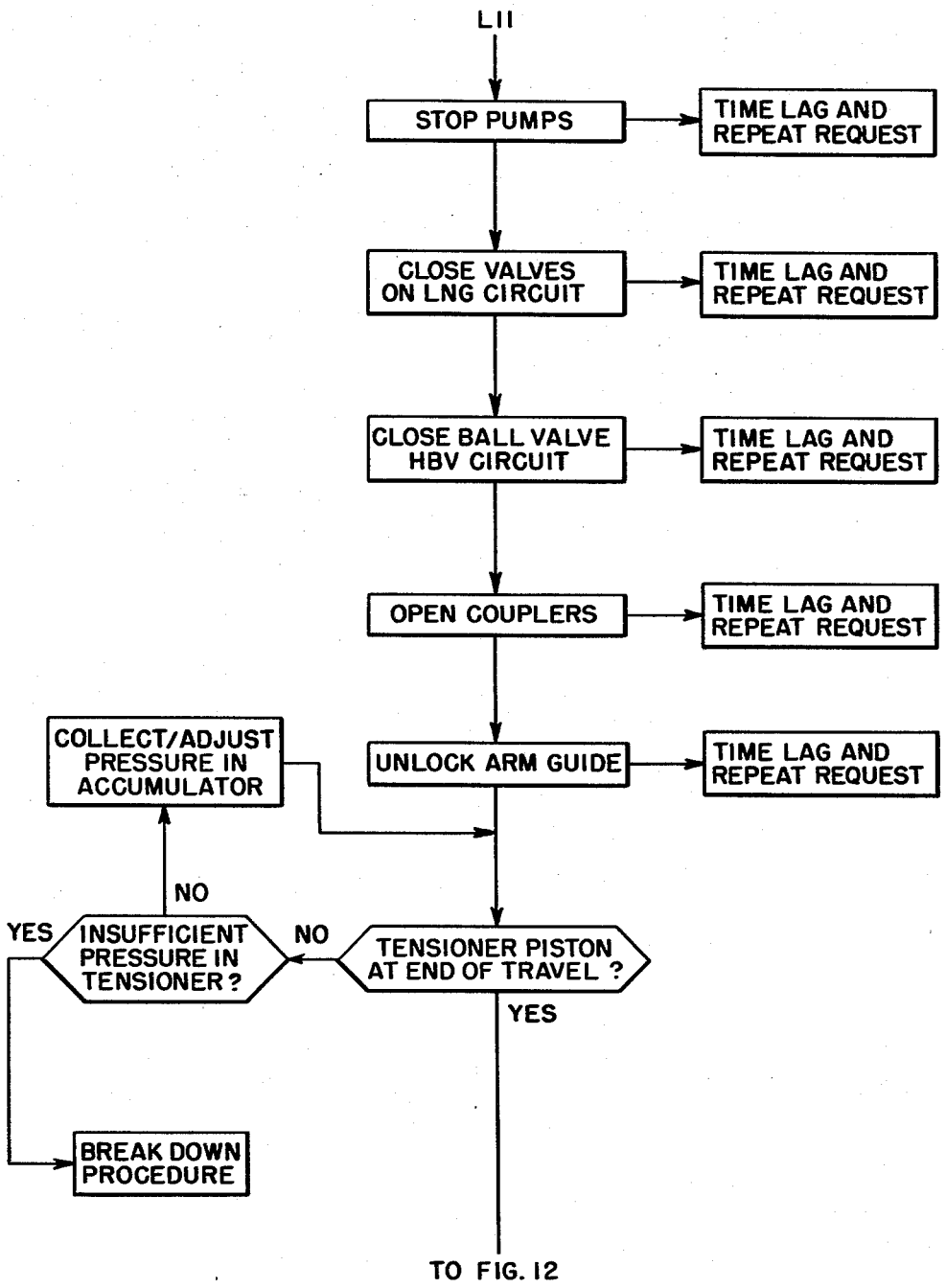
Figure 13:
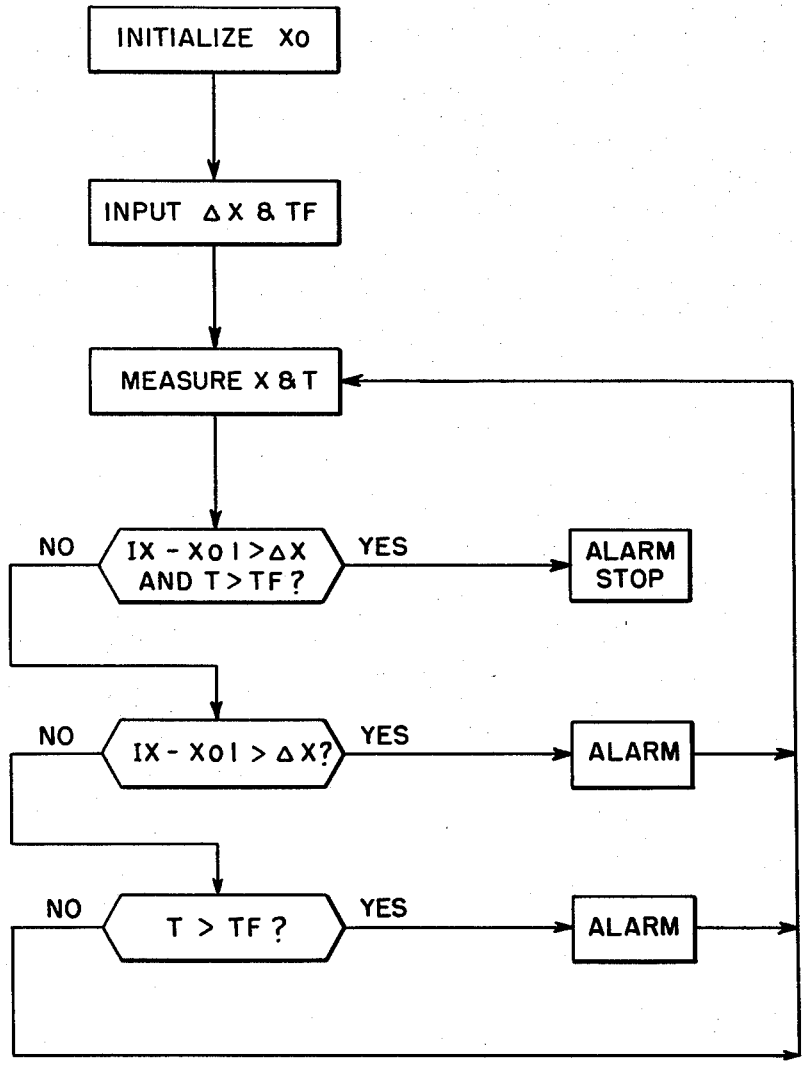
Figure 14:
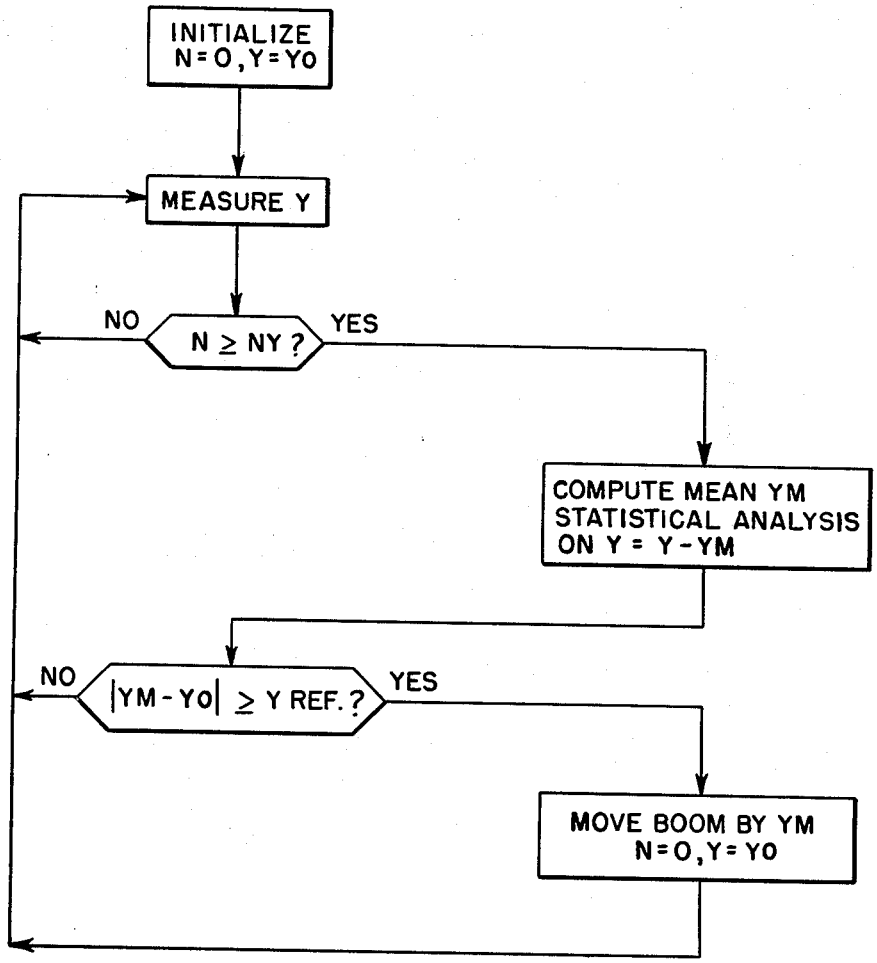
Figure 15:
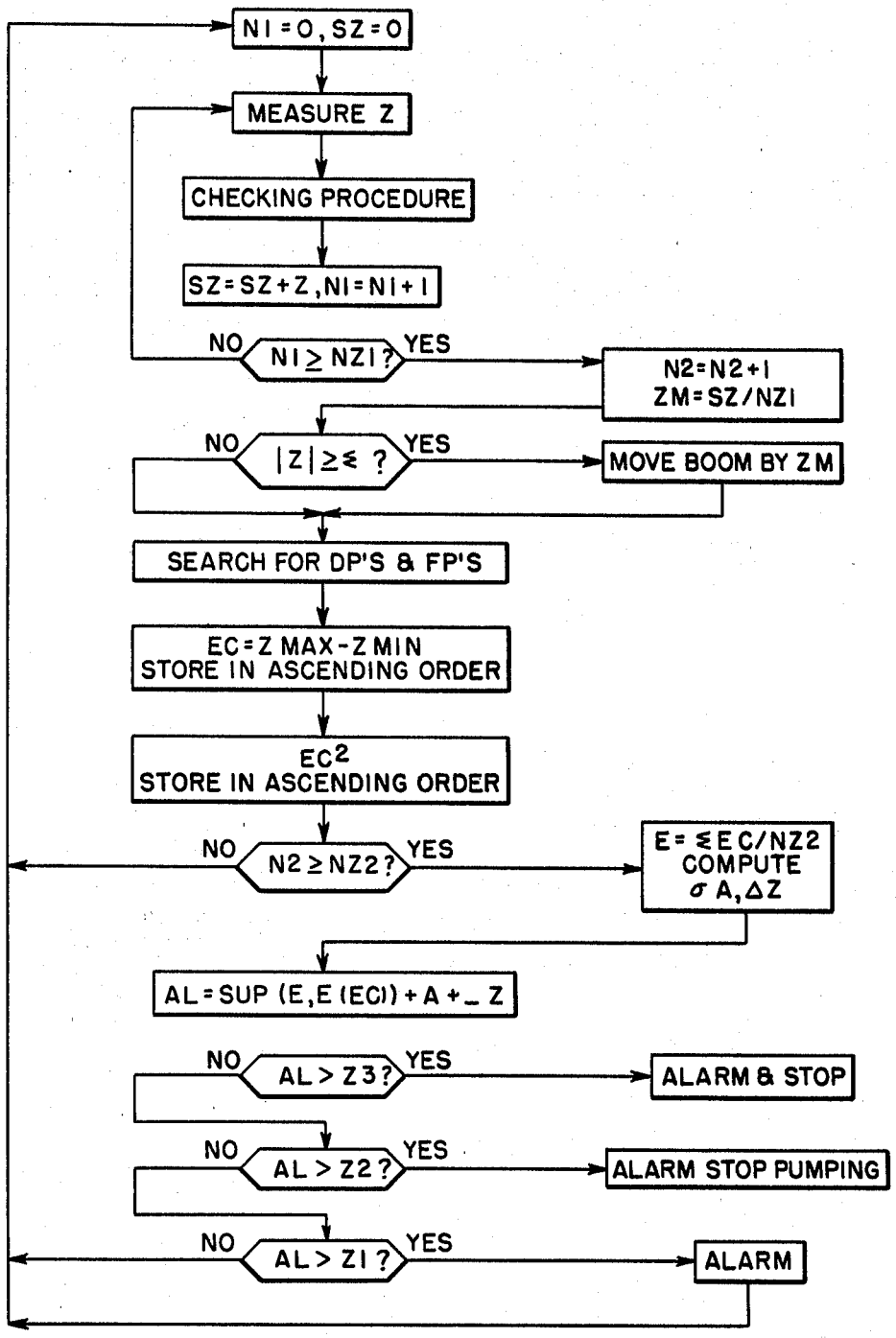
Figure 16:
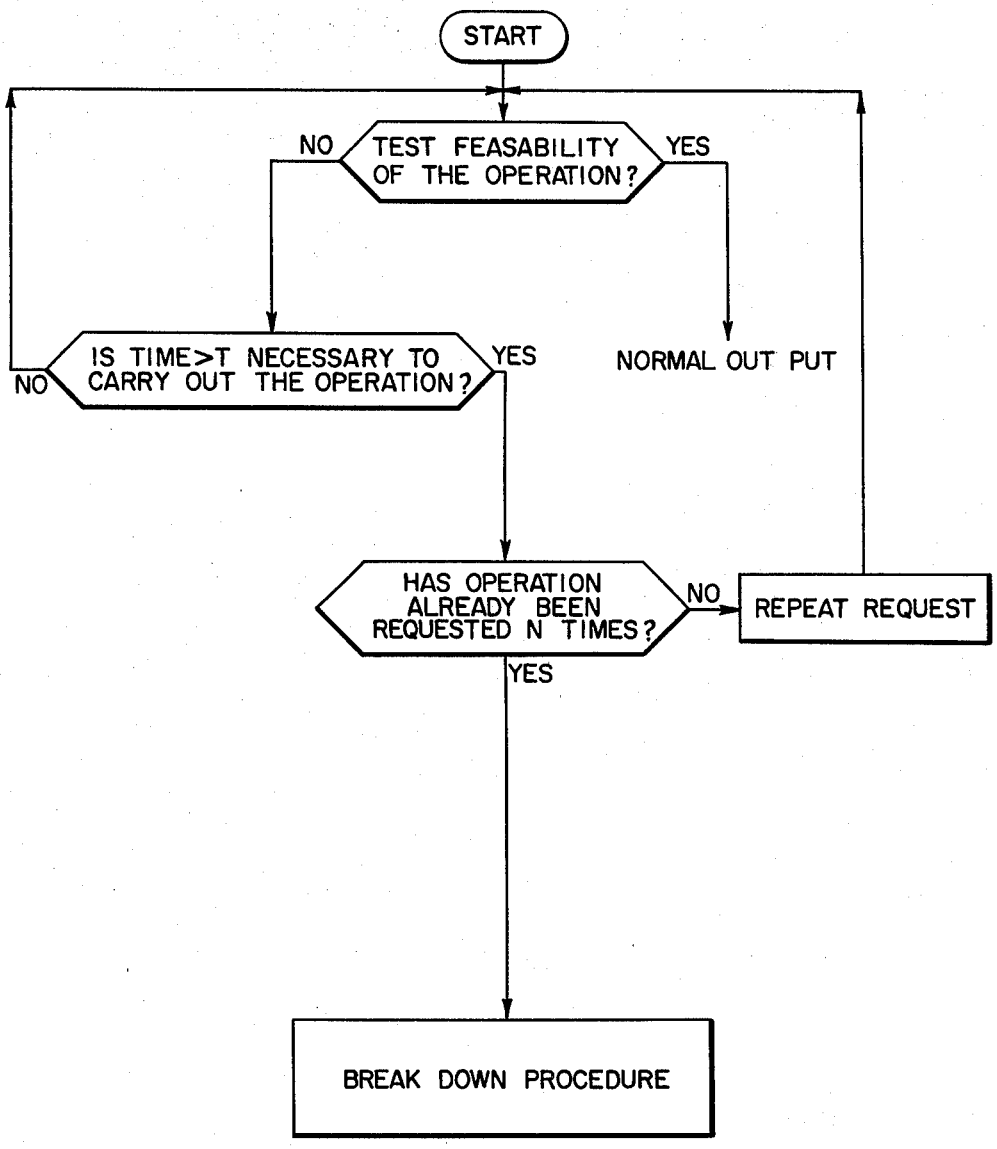
Figure 17:
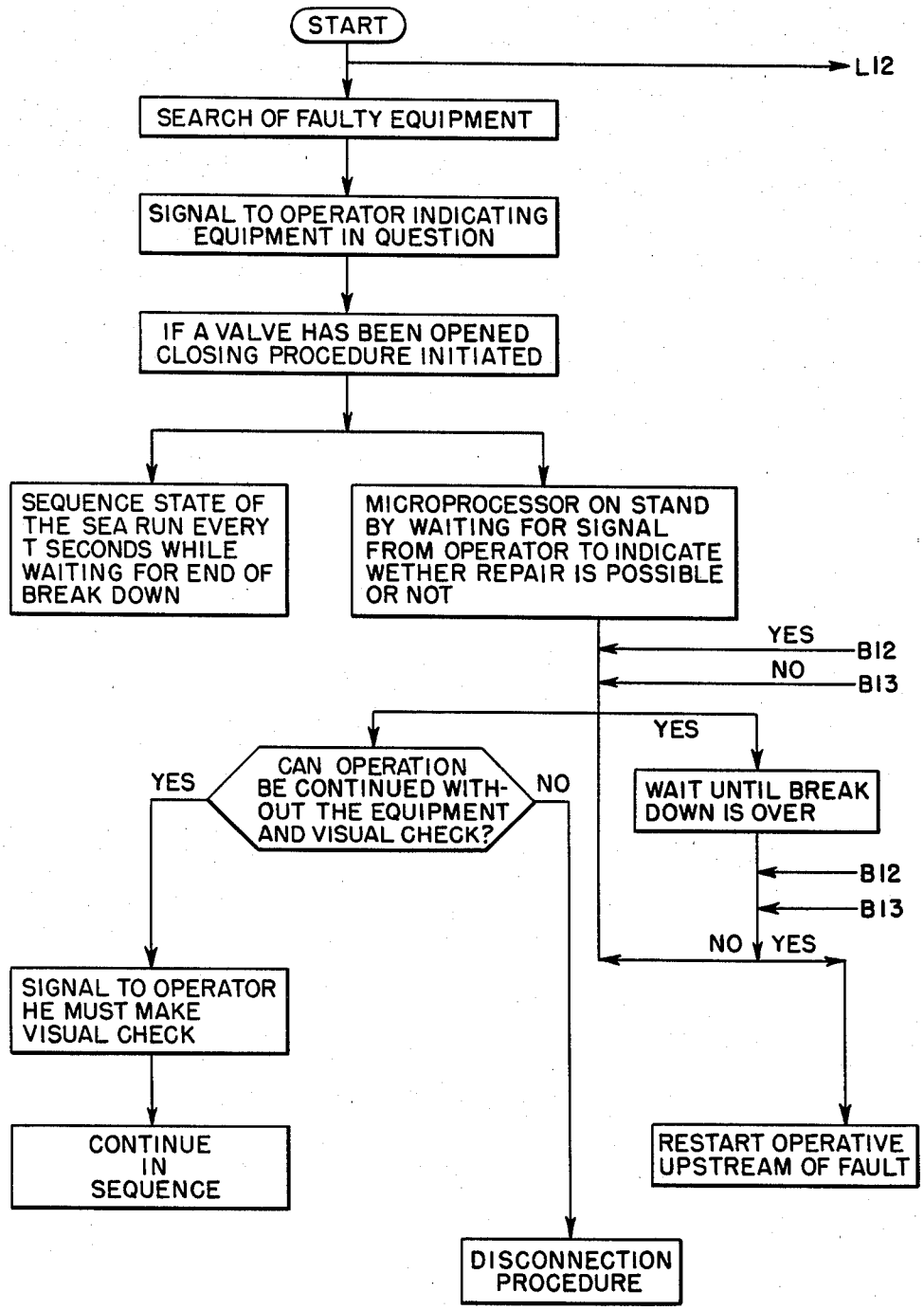

Information from the potentiometers on the loading arm and/or from the cameras CA, CB or other instrument 16 (FIG. 8) is coupled to A/D converter 17 and used by a computer 18 to calculate the spatial position of the outer end of the arm. The computer 18 periodically checks the position of the arm and determines the movement. The location and direction of arm movement are used to predict if the arm is going to move outside the safe area S (FIG. 3), and a warning is sounded whenever it predicts such a move will occur. If the computer predicts that the arm may move outside the safe area the flow of fluid through the arm is terminated, and if the arm moves into a further danger area the arm is disconnected from the tanker T. Flow charts which illustrate details of the procedures followed by the computer 18 are shown in FIGS. 9–17.

Although the best mode contemplated for carrying out the present invention has been herein shown and described, it will be apparent that modification and variation may be made without departing from what is regarded to be the subject matter of the invention.

What is claimed is:

1. Apparatus for monitoring the position in space of the outer end of an articulated fluid loading arm and for predicting when the outer end of the arm will move outside a safe operating area, said apparatus comprising:

means for sensing a first angle representative of the vertical orientation of said articulated arm;

means for sensing a second angle representative of the horizontal orientation of said articulated arm;

means for sensing a third angle representative of the rotational orientation of said articulated arm;

calculator means for using the values of said first, second and third angles to calculate the spatial position of the outer end of said articulated arm;

means for storing the spatial boundaries of a working area for said outer end of said arm;

means for comparing the actual spatial position of the outer end of said arm with said boundaries;

means for calculating the movement of the outer end of said arm and for determining if the outer end of said arm may move outside said working area; and means for terminating the flow of fluid through said arm when said calculating means predicts that the outer end of said arm is about to move outside said working area.

2. Apparatus as defined in claim 1 including means for warning that the outer end of said arm will probably move to said spatial boundary of said working area.

3. Apparatus as defined in claim 1 including means for disconnecting the outer end of said loading arm from a receiving vessel when the outer end of said arm moves outside a secondary set of boundaries outside said working area.

4. Apparatus for monitoring the position in space of the outer end of an articulated fluid loading arm relative to a platform and for terminating a loading operation when it is predicted that the outer end of the loading arm may move outside a safe operating area, said apparatus comprising:

means for sensing a first angle representative of the vertical orientation of said loading arm;

means for sensing a second angle representative of the horizontal orientation of said loading arm;

means for sensing a third angle representative of the rotational orientation of said loading arm;

means for using the values of said first, second and third angles to calculate the spatial position of the outer end of said loading arm relative to said platform;

means for storing the spatial boundaries of a working area for said outer end of said arm;

means for comparing the actual spatial position of the outer end of said arm with said boundaries;

calculating means for using successive spatial positions of the outer end of said arm for calculating the movement of the outer end of said arm and for predicting that the outer end of said arm may move outside said working boundaries;

means for terminating the flow of fluid through said arm when said calculating means predicts that the outer end of said arm may move outside said working boundaries; and means for disconnecting the outer end of said loading arm from a vessel being loaded when the outer end of said loading arm moves a predetermined distance outside one of said working boundaries.

5. Apparatus as defined in claim 4 including means for predicting that the outer end of said loading arm will probably reach one of said working boundaries and means for sounding an alarm when such a probability is determined.

6. Apparatus as defined in claim 4 including computing means for determining the probability of said loading arm moving into one of said boundaries of said safe working area.

7. Apparatus as defined in claim 6 wherein said computing means employs statistical analysis to determine the probability of said loading arm reaching said boundary as determined by the movement and position of the outer end of said arm.

8. Apparatus as defined in claim 7 wherein the inertia of the system for stopping fluid flow in said loading arm is used to aid in determining when the flow termination procedure should be initiated.

* * * * *